US007798592B2

(12) United States Patent
Mizugaki

(10) Patent No.: US 7,798,592 B2
(45) Date of Patent: Sep. 21, 2010

(54) DROPLET EJECTION HEAD DRIVE METHOD, DROPLET EJECTION DEVICE, AND ELECTROOPTIC APPARATUS

(75) Inventor: Koichi Mizugaki, Suwa (JP)

(73) Assignee: Seiko Epson Corporation (JP)

( * ) Notice: Subject to any disclaimer, the term of this patent is extended or adjusted under 35 U.S.C. 154(b) by 469 days.

(21) Appl. No.: 11/948,357

(22) Filed: Nov. 30, 2007

(65) Prior Publication Data

US 2008/0129770 A1 Jun. 5, 2008

(30) Foreign Application Priority Data

Dec. 1, 2006 (JP) ..... 2006-325268

(51) Int. Cl.
*B41J 29/38* (2006.01)

(52) U.S. Cl. ..... 347/15; 347/10; 347/19

(58) Field of Classification Search ..... 347/5, 347/9, 10, 11, 15, 19
See application file for complete search history.

(56) References Cited

U.S. PATENT DOCUMENTS 7,073,727 B2 7/2006 Usuda
2003/0234826 A1* 12/2003 Hosono et al. ..... 347/10
2006/0028500 A1* 2/2006 Sakaida et al. ..... 347/15

FOREIGN PATENT DOCUMENTS

| | | |
|---|---|---|
| JP | 08-146214 | 6/1996 |
| JP | 09-011457 | 1/1997 |
| JP | 11-248927 | 9/1999 |
| JP | 2003-320291 | 11/2003 |

* cited by examiner

*Primary Examiner*—Lam S Nguyen
(74) *Attorney, Agent, or Firm*—Harness, Dickey & Pierce, P.L.C.

(57) ABSTRACT

A droplet ejection head drive method includes (1) associating multiple nozzles with ranks corresponding to weights of droplets ejected from the nozzles, (2) generating drive waveforms for driving actuators of the nozzles and correcting the weights of the droplets to a predetermined weight, for each of the ranks, and (3) supplying the drive waveforms corresponding to the ranks of some of the nozzles selected according to drawing data, to actuators of the selected nozzles and ejecting droplets each having the predetermined weight from the selected nozzles onto a target.

4 Claims, 11 Drawing Sheets

| RANK | ACTUAL WEIGHT Iw | DRIVE WAVEFORM SIGNAL COM |
|---|---|---|
| 1 | Iwcen×1.02>Iw≧Iwcen×1.01 | COMA |
| 2 | Iwcen×1.01>Iw≧Iwcen | COMB |
| 3 | Iwcen>Iw≧Iwcen×0.99 | COMC |
| 4 | Iwcen×0.99>Iw≧Iwcen×0.98 | COMD |
FIG. 7
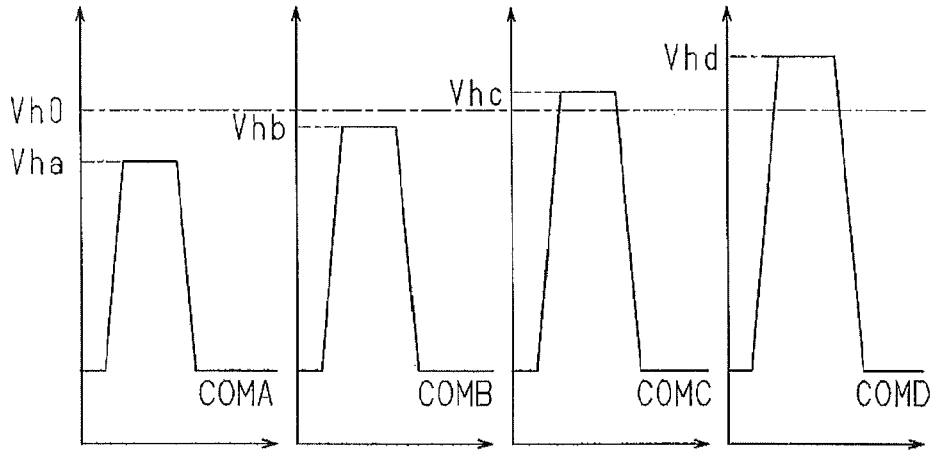
FIG. 8
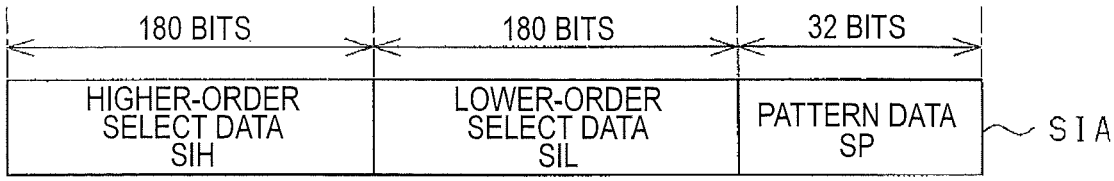
FIG. 9

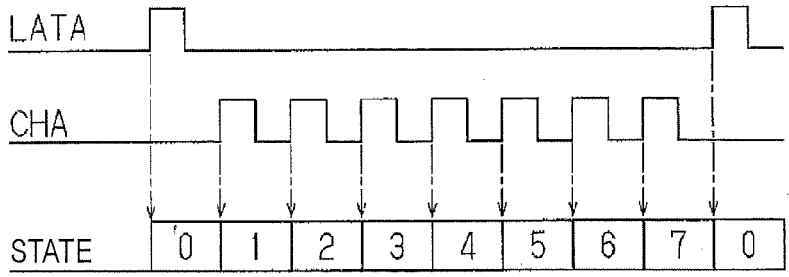
| SIH | SIL | SP | | | | | | | | |
|---|---|---|---|---|---|---|---|---|---|---|
| 0 | 0 | P00 | P10 | P20 | P30 | P40 | P50 | P60 | P70 | P00 |
| 0 | 1 | P01 | P11 | P21 | P31 | P41 | P51 | P61 | P71 | P01 |
| 1 | 0 | P02 | P12 | P22 | P32 | P42 | P52 | P62 | P72 | P02 |
| 1 | 1 | P03 | P13 | P23 | P33 | P43 | P53 | P63 | P73 | P03 |
FIG.10
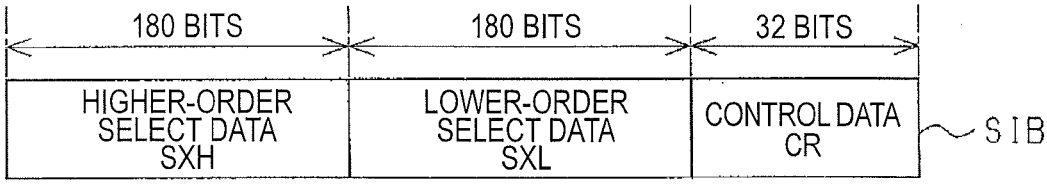
FIG.11
| HIGHER-ORDER SELECT DATA SXH | LOWER-ORDER SELECT DATA SXL | DRIVE WAVE-FORM SIGNAL COM |
|---|---|---|
| 0 | 0 | COMA |
| 0 | 1 | COMB |
| 1 | 0 | COMC |
| 1 | 1 | COMD |
FIG.12

DROPLET EJECTION HEAD DRIVE METHOD, DROPLET EJECTION DEVICE, AND ELECTROOPTIC APPARATUS

TECHNICAL FIELD

The present invention relates to a droplet ejection head drive method, a droplet ejection device, and an electrooptic apparatus

RELATED ART

Typical liquid crystal displays include a color filter substrate having a great number of pixels. Each pixel of such a color filter substrate receives light from a light source and passes through light of a particular wavelength so that an image is displayed in full color on the liquid crystal display. In order to improve productivity or reduce the production cost, the inkjet method using a droplet ejection head has been adopted in the process of manufacturing color filters (for example, JP-A-8-146214).

Such a droplet ejection head includes multiple cavities for storing liquid, multiple nozzles that communicate with the cavities and are arranged in one direction, and multiple actuators (for example, piezoelectric elements, resistance heating elements, etc.) for pressurizing the liquid in the cavities. In the droplet ejection head, common drive waveform signals are inputted to actuators selected according to drawing data, and liquid droplets are ejected from nozzles corresponding to the actuators. In the inkjet method, pixels are formed by supplying filter materials to the droplet ejection heads, ejecting droplets of the filter materials onto the color filter substrate, and drying the droplets that have landed on the substrate.

As drawing objects have higher degrees of definition, it is desired that drawing that is excellent in tone reproduction is performed in the inkjet method. In JP-A-9-11457, a common waveform generator for generating multiple drive voltage waveforms corresponding to the ejection amounts of ink is provided, and any one of the drive voltage waveforms generated by the common waveform generator is selected according to a tone data signal and supplied to an actuator. This allows the sizes of droplets to be changed using the different drive voltage waveforms. Thus, excellent tone reproduction is realized without having to make a change to the design, such as the inner diameter or formation pitch of a nozzle.

In the above-mentioned inkjet technique, the color filter substrate and the droplet ejection head move relatively to each other in predetermined traveling directions, and the above-mentioned drive voltage waveforms are inputted to the actuators at a predetermined ejection frequency. Thus, droplets are ejected one after another at the predetermined frequency from the arranged nozzles so that liquid patterns are drawn one after another in the traveling direction of the color filter substrate.

However, if variations occur in the weights of the droplets ejected from the nozzles arranged in a row, droplets with a larger weight or ones with a smaller weight continuously land in the traveling direction of the color filter substrate. As a result, the differences in film thickness occur in the traveling direction of the color filter substrate, thereby substantially deteriorating the display quality of the liquid crystal display.

Therefore, if the weights of droplets are corrected for each nozzle, uniformity in film thickness is improved, resulting in an improvement in display quality of the liquid crystal display.

SUMMARY

An advantage of the invention is to provide a droplet ejection head drive method, a droplet ejection device, and an electrooptic apparatus that each improve uniformity in thickness of film patterns formed by ejecting droplets.

According to a first aspect of the invention, a droplet ejection head drive method includes (1) associating multiple nozzles with ranks corresponding to weights of droplets ejected from the nozzles, (2) generating drive waveforms for driving actuators of the nozzles and correcting the weights of the droplets to a predetermined weight, for each of the ranks, and (3) supplying the drive waveforms corresponding to the ranks of some of the nozzles selected according to drawing data, to actuators of the selected nozzles and ejecting droplets each having the predetermined weight from the selected nozzles onto a target.

According to the droplet ejection head drive method according to the first aspect of the invention, the nozzles selected according to the drawing data receive drive waveforms corresponding to the set ranks to eject droplets each having the predetermined weight. Therefore, the weights of droplets to be ejected from the multiple nozzles are standardized into the predetermined weight according to drive waveforms generated for each rank. As a result, the weights of droplets are corrected for each nozzle, thereby improving the uniformity in thickness of a thin film formed of droplets.

In the droplet ejection head drive method according to the first aspect of the invention, in step (3), all the nozzles may be associated with the drive waveforms corresponding to the ranks, and ejection/non-ejection of a droplet may be set with respect to all the nozzles.

According to the droplet ejection head drive method according to the first aspect of the invention, all the nozzles are associated with drive waveforms corresponding to the ranks regardless of whether or not a droplet is ejected from the nozzles. Therefore, the nozzles selected according to the drawing data are more reliably driven according to the corresponding drive waveforms.

In the droplet ejection head drive method according to the first aspect of the invention, in step (3), all the nozzles may be associated with the drive waveforms corresponding to the ranks each time ejection/non-ejection of a droplet is set with respect to all the nozzles.

According to the droplet ejection head drive method according to the first aspect of the invention, each nozzle is associated with a drive waveform each time ejection/non-ejection of a droplet is set with respect to the nozzle. Therefore, all the nozzles are more reliably driven according to the corresponding drive waveforms.

In the droplet ejection head drive method according to the first aspect of the invention, in step (3), all the nozzles may be associated with the drive waveforms corresponding to the ranks and then setting of ejection/non-ejection of a droplet may be repeated with respect to all the nozzles.

According to the droplet ejection head drive method according to the first aspect of the invention, all the nozzles are associated with drive waveforms only once regardless of whether or not a droplet is ejected from the nozzles and then setting of ejection/non-ejection of a droplet is repeated with respect to all the nozzles. Therefore, all the nozzles are each continuously associated with an identical drive waveform. All the nozzles are more reliably driven according to the corresponding drive waveforms.

According to a second aspect of the invention, a droplet ejection device for supplying drive waveforms to multiple actuators provided in a droplet ejection head and ejecting droplets from nozzles corresponding to the actuators includes an output control signal generator for generating an output control signal in which the multiple nozzles are associated with ejection/non-ejection of a droplet, according to drawing data; a storage device for storing information in which the multiple nozzles are associated with ranks set according to the weights of the droplets; a drive waveform generator for generating drive waveforms associated with the ranks, the drive waveforms correcting the weights of the droplets to a predetermined weight; a common select control signal generator for generating a common select control signal in which the multiple nozzles are associated with the drive waveforms corresponding to the ranks, using the information stored in the storage device; and an output device for outputting the drive waveforms corresponding to the ranks to the actuators of the nozzles, according to the common select control signal and the output control signal.

According to the droplet ejection device according to the second aspect of the invention, the nozzles selected according to the drawing data receive drive waveforms corresponding to the set ranks to eject droplets each having the predetermined weight. Therefore, the weights of droplets to be ejected from the multiple nozzles are standardized into the predetermined weight according to the drive waveforms corresponding to the ranks. As a result, the weights of the droplets are corrected for each nozzle, thereby improving the uniformity in thickness of the thin film formed of droplets.

In the droplet ejection device according to the second aspect of the invention, the common select control signal generator may generate the common select control signal synthesized with the output control signal. The output device may output the drive waveforms corresponding to the ranks, to the actuators of the nozzles, according to the output control signal and the common select control signal synthesized with the output control signal.

According to the droplet ejection device according to the second aspect of the invention, whenever each nozzle ejects a droplet, the nozzle is associated with a drive waveform. Therefore, all the nozzles are more reliably driven according to the corresponding drive waveforms.

In the droplet ejection device according to the second aspect of the invention, the common select control signal generator may generate the common select control signal before the output control signal is generated. The output device may output the drive waveforms corresponding to the ranks, to the actuators of the nozzles, using the common select control signal generated in advance, each time the output device receives the output control signal.

According to the droplet ejection device according to the second aspect of the invention, all the nozzles are associated with drive waveforms only once and then each nozzle repeatedly ejects a droplet according an identical type of drive waveform. Therefore, all the nozzles are each continuously associated with an identical type of drive waveform. All the nozzles are more reliably driven according to the corresponding drive waveforms.

The droplet ejection device according to the second aspect of the invention may further include a droplet weight device for measuring a weight of a droplet.

According to the droplet ejection device according to the second aspect of the invention, the weights of droplets are measured and more correct weights are obtained compared with a case in which the weights of the droplets are measured by an external device. As a result, the weights of droplets are more correctly standardized.

According to a third aspect of the invention, an electrooptic device includes a film formed by drying a droplet ejected onto a substrate by the droplet ejection device according to the second aspect of the invention.

According to the electrooptic device according to the third aspect of the invention, the uniformity in thickness of each thin film is improved, resulting in an improvement in optical characteristic of the electrooptic device.

BRIEF DESCRIPTION OF THE DRAWINGS

The invention will be described with reference to the accompanying drawings, wherein like numbers reference like elements.

FIG. 7 is a diagram showing the ranks of nozzles according to this embodiment.

FIG. 8 is a diagram showing drive waveforms according to this embodiment.

FIG. 9 is a diagram showing serial pattern data according to this embodiment.

FIG. 10 is a timing chart showing pattern data according to this embodiment.

FIG. 11 is a diagram showing serial common select data according to this embodiment.

FIG. 12 is a diagram showing the associations of the ranks with the drive waveform signals.

DESCRIPTION OF EXEMPLARY EMBODIMENTS

Figure 1:
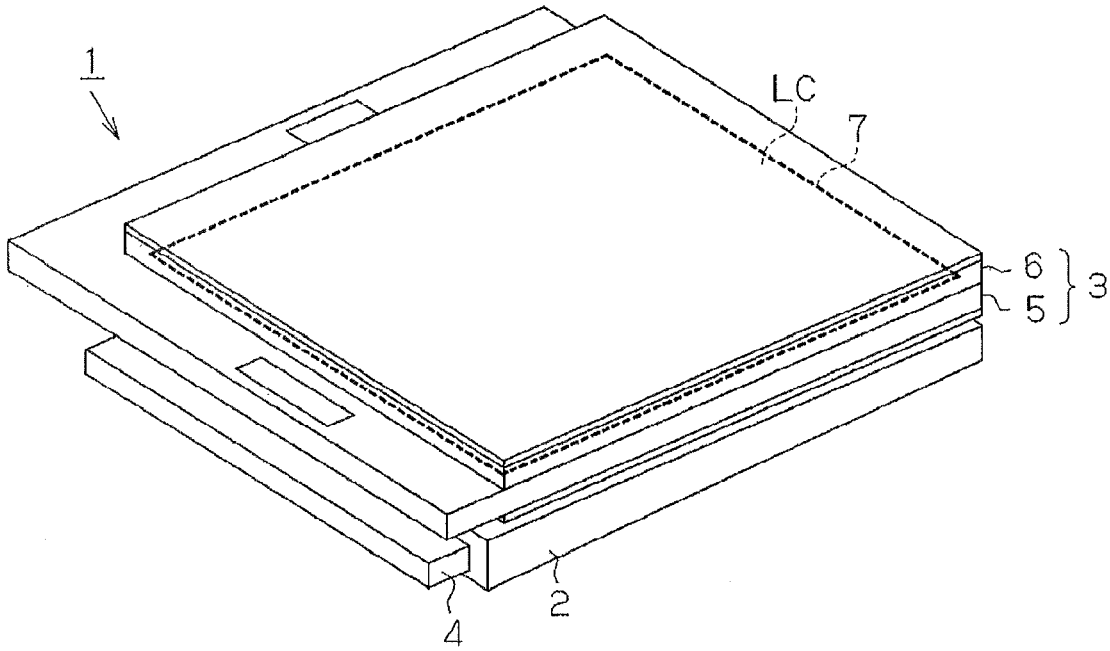
FIG. 1 is a perspective view showing a liquid crystal display according to an embodiment of the invention.
Figure 2:
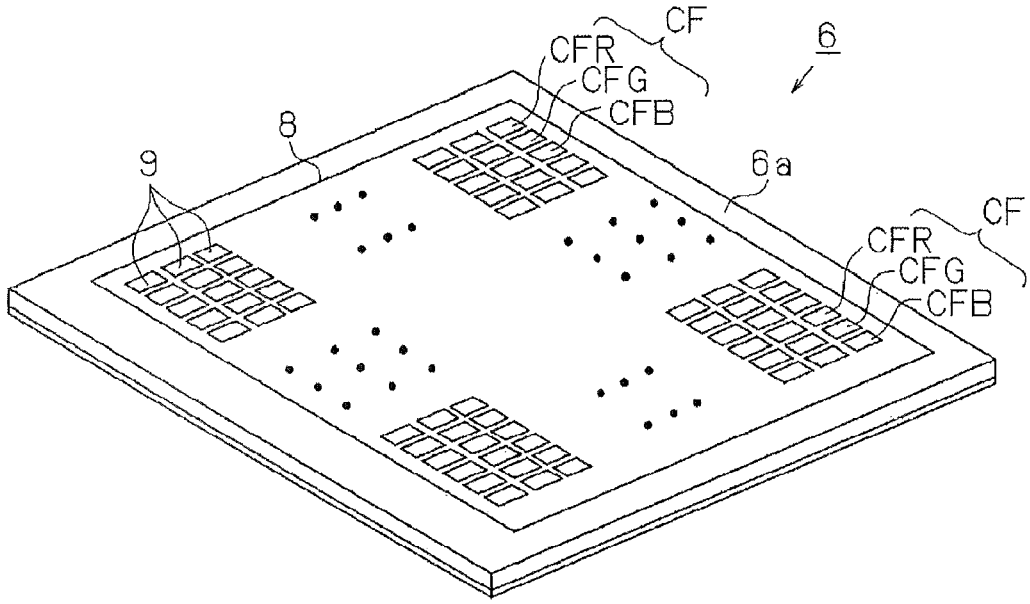
FIG. 2 is a perspective view showing a color filter substrate according to this embodiment.

An embodiment of the invention will now be described with reference to FIGS. 1 to 18. First, a liquid crystal display 1 that is an example of an electrooptic device will be described. FIG. 1 is an overall perspective view showing the liquid crystal display 1. FIG. 2 is a perspective view showing a color filter substrate included in the liquid crystal display 1.

In FIG. 1, the liquid crystal display 1 includes a backlight 2 and a liquid crystal panel 3. The backlight 2 applies light emitted from a light source 4 to the entire surface of the liquid crystal panel 3. The liquid crystal panel 3 includes an element substrate 5 and a color filter substrate 6. These substrates are bonded together by a sealing material 7 taking the shape of a rectangle frame, and liquid crystal LC is sealed in the gap therebetween. The liquid crystal LC modulates the light emitted from the backlight 2 so that a desired image is displayed on the lower surface of the color filter substrate 6.

In FIG. 2, a latticed light shielding layer 8 and a great number of spaces (pixels 9) surrounded by the light shielding layer 8 are formed on the upper surface of the color filter substrate 6 (the lower surface of the color filter substrate 6 in FIG. 1, that is, the side of the color filter substrate 6 that faces the element substrate 5). The light shielding layer 8, which is made of a resin including a light shielding material such as chrome or carbon black, shields light that has passed through the liquid crystal LC. Each of the pixels 9 includes a color filter CF that is a thin film through which light of a particular wavelength is passed. For example, the color filter CF includes a red filter CFR through which red light is passed, a green filter CFG through which green light is passed, and a blue filter CFB through which blue light is passed. The color filter CF is formed using a droplet ejection device according to the invention. That is, the color filter CF is formed by ejecting droplets of filter materials into the corresponding pixels 9 and drying the droplets that have landed on the pixels 9. Hereafter, the upper surface of the color filter substrate 6 (the lower surface thereof in FIG. 1) will be referred to as an ejection surface 6*a*.

Figure 3:
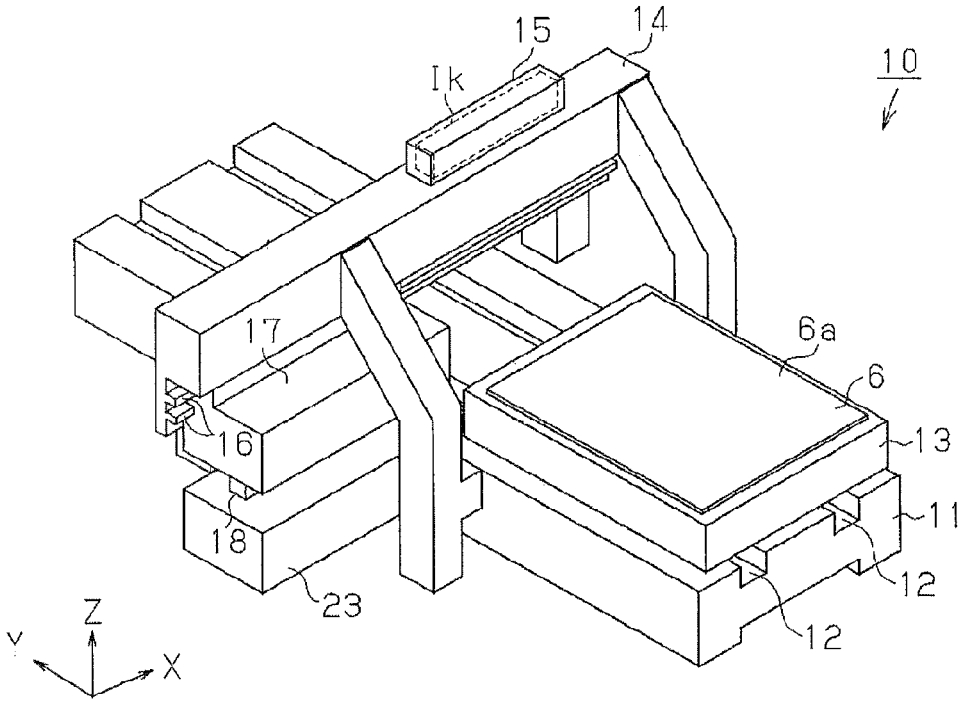
FIG. 3 is a perspective view showing a droplet ejection device according to this embodiment.

A droplet ejection device for forming the above-mentioned color filter CF will now be described. FIG. 3 is an overall perspective view showing the droplet ejection device.

In FIG. 3, a droplet ejection device 10 includes a box-shaped base 11. Formed on the upper surface of the base 11 are a pair of guide grooves 12 extending in the length direction (Y direction) of the base 11. Mounted on the pair of guide grooves 12 is a substrate stage 13. The substrate stage 13 is coupled to the output axis of a stage motor provided in the base 11. The color filter substrate 6 is placed on the substrate stage 13 with the ejection surface 6*a* upward, and is registered and fixed to the stage. When the stage motor rotates forward or backward, the substrate stage 13 travels along the guide grooves 12 at a predetermined speed so that the color filter substrate 6 travels in the Y direction.

A gate-shaped guide member 14 is provided above the base 11 in the X direction perpendicular to the Y direction. Provided on the guide member 14 is an ink tank 15. The ink tank 15 stores liquid (filter ink Ik) including a filter material and emits the filter ink Ik at a predetermined pressure.

Formed on the guide member 14 are a pair of guide rails that are provided vertically and extend in the X direction. Mounted on the pair of guide rails is a carriage 17. The carriage 17 is coupled to the output axis of a carriage motor provided in the guide member 14. Mounted below the carriage 17 are multiple droplet ejection heads 18 (hereafter simply referred to as "ejection heads 18") arranged in the X direction. When the carriage motor rotates forward or backward, the carriage 17 travels along the guide rails 16 so that the ejection heads 18 travel in the X direction.

Figure 4:
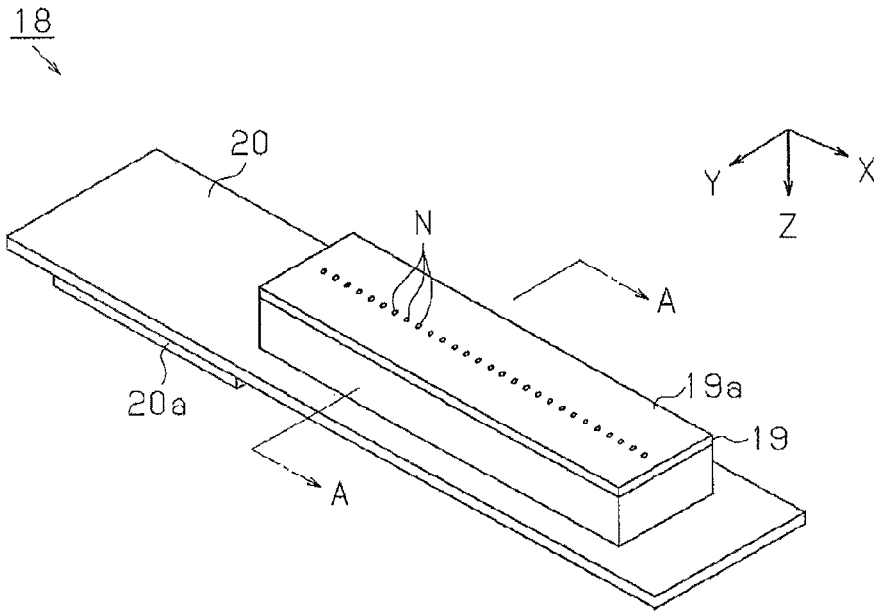
FIG. 4 is a perspective view showing the droplet ejection device.
Figure 5:
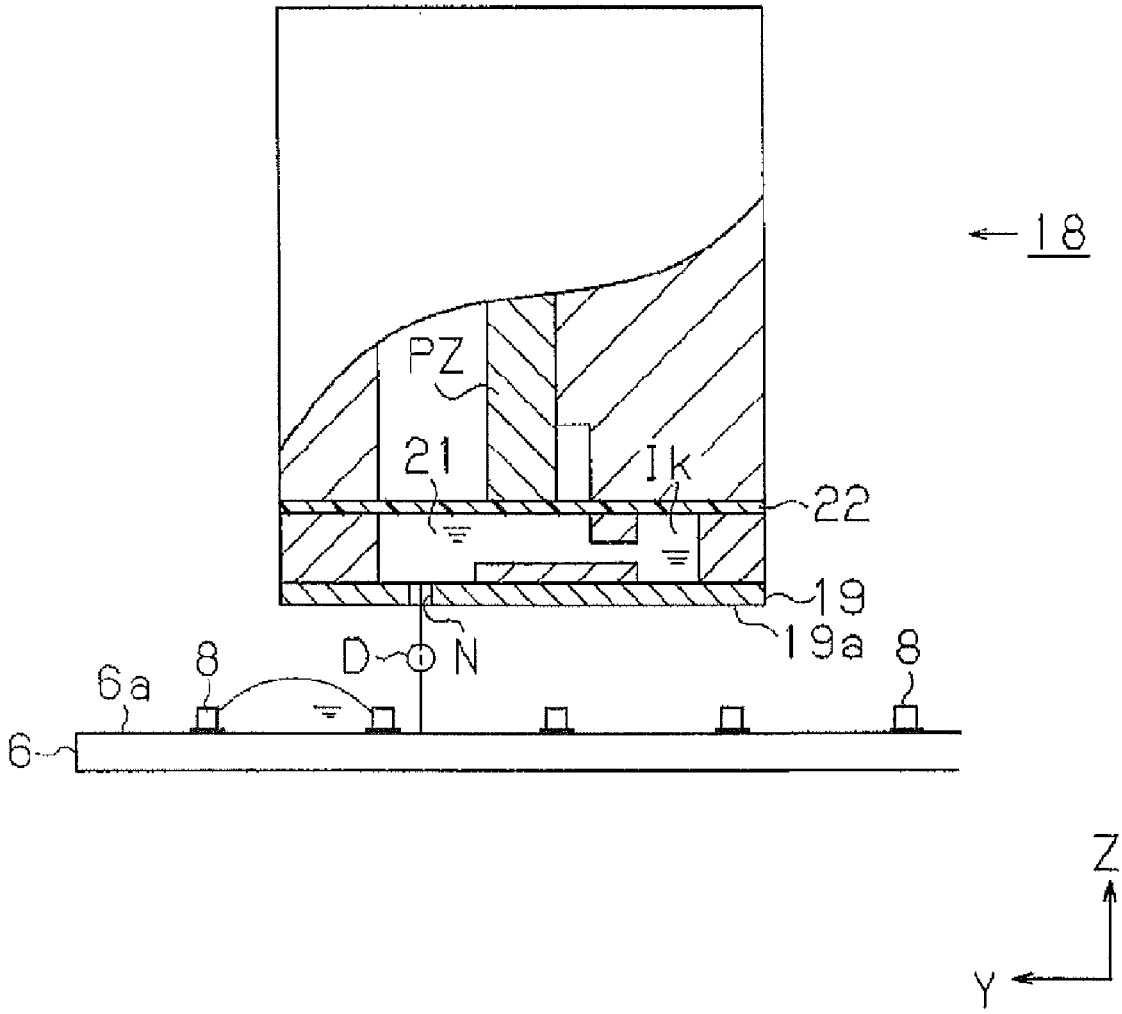
FIG. 5 is a main sectional view showing the droplet ejection device.

FIG. 4 is a drawing of one of the ejection heads 18 seen from below (from the substrate stage 13 side) in FIG. 3. FIG. 5 is a sectional view taken along line A-A of FIG. 4 in an inverted state.

In FIG. 4, the ejection head 18 includes a nozzle plate 19 in its upper part (its lower part in FIG. 3). The upper surface (lower surface in FIG. 3) of the nozzle plate 19 serves as a nozzle formation surface 19*a* in parallel to the color filter substrate 6. One hundred eighty through holes (nozzle holes N) penetrate the nozzle formation surface 19*a* in the direction of a normal to the nozzle formation surface 19*a* and are arranged in the X direction at equal intervals. Provided below the ejection head 18 (on the ejection head 18 in FIG. 3) is a head substrate 20. Provided at one edge of the head substrate 20 is an input terminal 20*a*. Various types of signals for driving the ejection head 18 are inputted to the input terminal 20*a*.

In FIG. 5, a cavity 21 that communicates with the ink tank 15 is formed on each nozzle N. Each cavity 21 stores the filter ink Ik emitted from the ink tank 15 and supplies the ink to the corresponding nozzle N. Provided on the cavity 21 is a diaphragm 22 that is able to vibrate vertically and expands or shrinks the volume of the corresponding cavity 21. Provided on the diaphragm 22 is a piezoelectric element PZ serving as an actuator. Upon receipt of a signal for driving itself (drive waveform signal COM), each piezoelectric element PZ shrinks or expands vertically so as to vibrate the corresponding diaphragm 22.

When the diaphragm 22 vibrates, the corresponding cavity 21 vertically vibrates the meniscus of the corresponding nozzle N, whereby the corresponding nozzle N ejects a droplet D of the filter ink Ik with a predetermined weight according to a drive waveform signal COM (drive voltage). The ejected droplet D flies along an approximate normal to the color filter substrate 6 and lands in a position on the ejection surface 6*a* that faces the nozzle N.

In FIG. 3, a droplet weight device 23 is provided on the left of the base 11. The droplet weight device 23 is a device for weighing the weight (actual weight Iw) of a droplet D ejected from each nozzle N. Known weighing devices may be used as the droplet weight device 23. For example, an electronic balance may be used to receive an ejected droplet D with the balance's saucer to weigh the droplet D. Also, a device that uses a piezoelectric vibrator having an electrode and detects the actual weight IW of a droplet D according to the resonant frequency of the piezoelectric vibrator that varies due to the landing of the droplet D ejected onto the electrode may be used as the droplet weight device 23.

Here, the average of the actual weights Iw of droplets D ejected from all the nozzles N in a row is defined as an average actual weight Iwcen. The average actual weight Iwcen is determined by $$Iwcen=(Iwmax+Iwmin)/2$$

where Iwmax is the maximum of the actual weights Iw of the ejected droplets D, and Iwmin is the minimum thereof. The average actual weight Iwcen is determined for each of the multiple ejection heads 18 included in the carriage 17.

The electrical configuration of the above-mentioned droplet ejection device 10 will now be described with reference to FIGS. 6 to 18.

Figure 6:
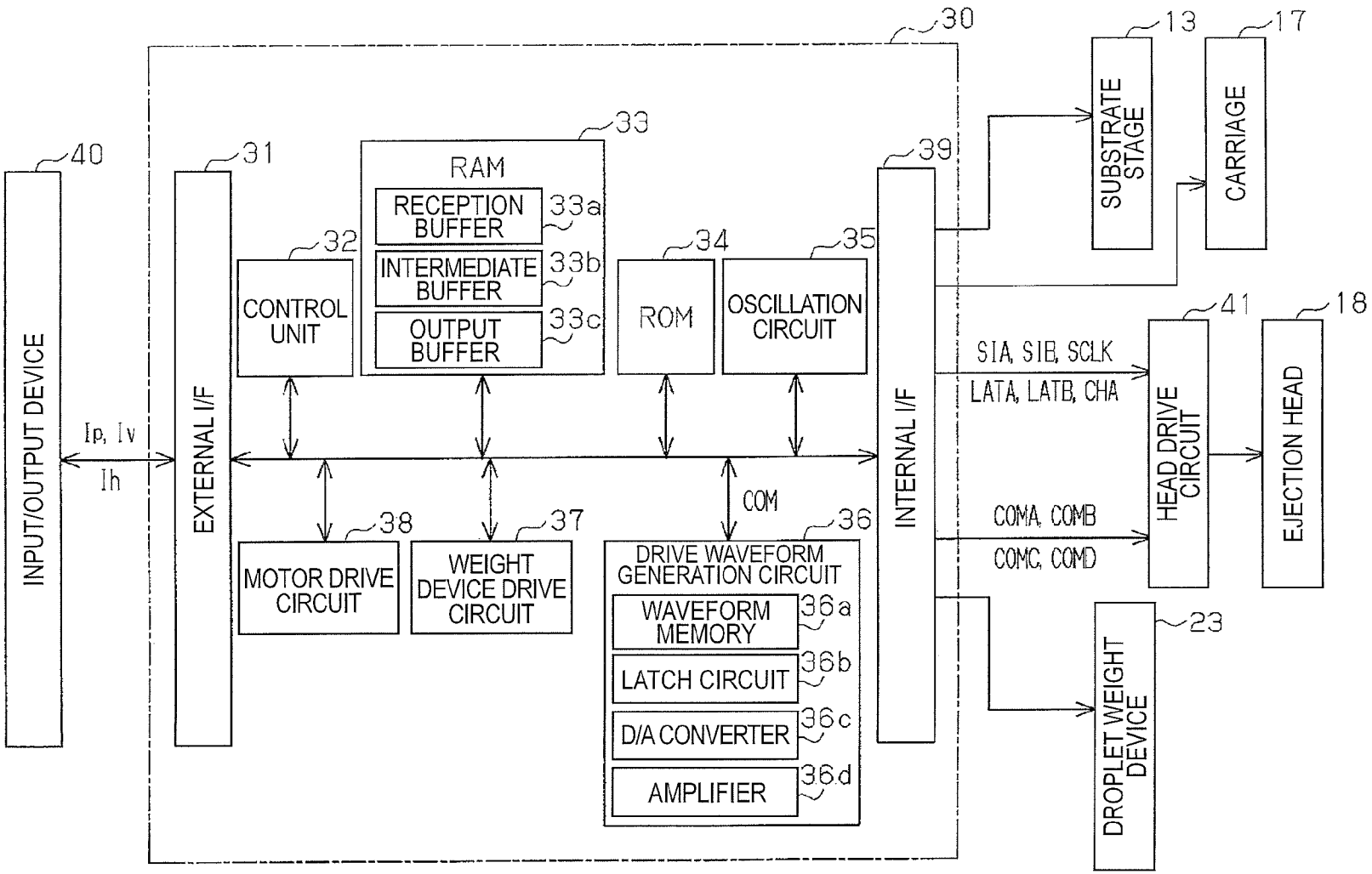
FIG. 6 is an electrical block circuit diagram showing the electrical configuration of the droplet ejection device.

FIG. 6 is a block circuit diagram showing the electrical configuration of the droplet ejection device 10. In FIG. 6, a control device 30 is a device that causes the droplet ejection device 10 to perform various types of processes. The control device 30 includes an external I/F 31, a control unit 32 including a central processing unit (CPU) and the like, a ROM 33 including a dynamic random access memory (DRAM) and a static random access memory (SRAM) and serving as a storage device for storing various types of data, and a ROM 34 for storing various types of control programs. The control device 30 also includes an oscillation circuit 35 for generating clock signals, a drive waveform generation circuit 36 serving as a drive waveform generator for generating drive waveform signals COM, a weight device drive circuit 37 for driving the droplet weight device 23, a motor drive circuit 38 for causing the substrate stage 13 and the carriage 17 to travel, and an internal I/F 39 for transmitting various types of signals. The control device 30 is coupled to an input/output device 40 via the external I/F 31. The control device 30 is also coupled to multiple head drive circuits 41 corresponding to the substrate stage 13, the carriage 17, the droplet weight device 23, and the ejection heads 18, via the internal I/F 39.

For example, the input/output device 40 is an external computer including a CPU, a random access memory (RAM), a read-only memory (ROM), a hard disk, a liquid crystal display, and the like. The input/output device 40 outputs various types of control signals for driving the droplet ejection device 10 to the external I/F 31, in accordance with a control program stored in the ROM or hard disk. The external I/F 31 receives drawing data Ip, reference drive voltage data Iv, and head data Ih from the input/output device 40.

Here, the drawing data Ip refers to various types of data for ejecting droplets D onto the pixels 9 of the ejection surface 6*a*, such as information on the position and thickness of the color filter CF, information on the position in which a droplet D is to be ejected, and information on the traveling speed of the substrate stage 13.

The reference drive voltage data Iv is data on a drive voltage (reference drive voltage Vh0) for correcting the average actual weight Iwcen to a predetermined weight (reference weight). Since the average actual weight Iwcen varies depending on the ejection heads 18, the reference drive voltage data Iv is applied to each ejection head 18. In other words, the reference drive voltage data Iv is data for correcting the average actual weight Iwcen of each ejection head 18 to a common reference weight.

The head data Ih refers to data in which the nozzles N (piezoelectric elements PZ) are categorized into four "ranks," that is, the nozzles N are associated with the ranks according to the weights of the droplets D ejected from these nozzles. For example, in the head data Ih, as shown in FIG. 7, a rank "1" is set to a nozzle if the actual weight Iw of a droplet D ejected from the nozzle satisfies $Iwcen \times 1.02 > Iw \geqq Iwcen \times 1.01$. A rank "2" is set to a nozzle if the actual weight Iw of a droplet D ejected from the nozzle satisfies $Iwcen \times 1.01 > Iw \geqq Iwcen$. A rank "3" is set to a nozzle if the actual weight Iw of a droplet D ejected from the nozzle satisfies $Iwcen > Iw \geqq Iwcenx0.99$. A rank "4" is set to a nozzle if the actual weight Iw of a droplet D ejected from the nozzle satisfies $Iwcenx \times 0.99 > Iw \geqq Iwcenx \times 0.98$.

FIG. 6, the RAM 33 is used as a reception buffer 33*a*, an intermediate buffer 33*b*, and an output buffer 33*c*. The ROM 34 stores various types of control routines to be executed by the control unit 32 and various types of data for executing the control routines. For example, the ROM 34 stores tone data for associating each dot with a tone and rank data for associating each nozzle with a drive waveform signal COM corresponding to the rank of the nozzle.

The tone data refers to data for forming one dot with multiple droplets D and for reproducing pseudo multiple tones using two tones of whether to eject a droplet D (that is, ejection or non-ejection). The rank data refers to data for associating each rank ("1" to "4") with any one of four different drive waveform signals COM (a first drive waveform signal COMA, a second drive waveform signal COMB, a third drive waveform signal COMC, and a fourth drive waveform signal COMD). In other words, the rank data is data for associating each of all the nozzles N with a drive waveform signal COM corresponding to the rank of the nozzle.

In FIG. 6, the oscillation circuit 35 generates clock signals for synchronizing various types of data or various types of drive signals. For example, the oscillation circuit 35 generates transfer clocks SCLK to be used when various types of data is serial-transferred. The oscillation circuit 35 generates latch signals (latch signals LATA for pattern data or latch signals LATB for common select data) to be used when the serial-transferred various types of data is parallel-converted. The oscillation circuit 35 also generates STATE switch signals CHA for setting the timings at which droplets D are ejected.

The drive waveform generation circuit 36 includes a waveform memory 36*a*, a latch circuit 36*b*, a D/A converter 36*c*, and an amplifier 36*d*. The waveform memory 36*a* stores waveform data for drive waveform signals COM in such a manner that the waveform data is associated with a predetermined address. The latch circuit 36*b* latches the waveform data read from the waveform memory by the control unit 32, using a predetermined clock signal. The D/A converter 36*c* converts the waveform data latched by the latch circuit 36*b* into an analog signal. The amplifier 36*d* amplifies the analog signal converted into by the D/A converter 36*c* and simultaneously generates a drive waveform signal COM.

Upon receipt of the reference drive voltage data Iv from the input/output device 40, the control unit 32 refers to the reference drive voltage data Iv to read the waveform data from the waveform memory 36*a* of the drive waveform generation circuit 36. Then the control unit 32 causes the drive waveform generation circuit 36 to generate four types of drive waveform signals COM (first drive waveform signals COMA, second drive waveform signals COMB, third drive waveform signals COMC, and fourth drive waveform signals COMD) synchronized with the ejection frequency.

The control unit 32 causes the drive waveform generation circuit 36 to generate the first to fourth drive waveform signals COMA, COMB, COMC, and COMD as signals having different drive voltages according to the ranks "1" to "4", respectively. For example, as shown in FIGS. 7 and 8, the control unit 32 causes the drive waveform generation circuit 36 to generate the first drive waveform signal COMA as a signal having a drive voltage (first drive voltage Vha) corresponding to a nozzle N set to the rank "1." The first drive voltage Vha is a voltage (e.g., $Vha = Vh0 \times 0.985$) lower than the reference drive voltage Vh0. Therefore, when a piezoelectric element PZ corresponding to the nozzle N set to the rank "1" receives the first drive waveform signal COMA, the drive amount (expansion/shrinkage amount) of the piezoelectric element PZ is reduced by the difference between first drive voltage Vha and the reference drive voltage Vh0, whereby the actual weight Iw of a droplet D to be ejected from the nozzle N is corrected to the reference weight.

Similarly, the control unit 32 causes the drive waveform generation circuit 36 to generate the second to fourth drive waveform signals COMB, COMC, and COMD as signals having drive voltages (second to fourth drive voltages Vhb, Vhc, and Vhd) corresponding to the ranks "2," "3," and "4," respectively. The second to fourth drive voltages Vhb, Vhc, and Vhd are $Vhb = Vh0 \times 0.995$, $Vhc = Vh0 \times 1.005$, and $Vhd = Vh0 \times 1.015$, respectively. When piezoelectric elements PZ corresponding to nozzles N set to the ranks "2" to "4" receive the second to fourth drive waveform signals COMB, COMC, and COMD, respectively, the respective actual weights Iw of droplets D to be ejected from these nozzles N are corrected to the reference weight according to the drive voltages corresponding to the ranks.

Thus, by inputting, to all the nozzles N (piezoelectric elements PZ), drive waveform signals COM corresponding to the ranks of these nozzles, the actual weights Iw of droplets D to be ejected from these nozzles are standardized to the common reference weight.

In FIG. 6, the control unit 32 outputs a drive control signal to the weight device drive circuit 37. In response to the drive control signal from the control unit 32, the weight device drive circuit 37 drives the droplet weight device 23 via the internal I/F 39.

The control unit 32 outputs a drive control signal to the motor drive circuit 38. In response to the drive control signal from the control unit 32, the motor drive circuit 38, via the internal I/F 39, causes the substrate stage 13 and the carriage 17 to travel.

The control unit 32 temporarily stores the drawing data Ip received by the external I/F 31, in the reception buffer 33*a*. Then, the control unit 32 converts the drawing data Ip into an intermediate code and stores the intermediate code in the intermediate buffer 33*b* as intermediate code data. Then, the control unit 32 reads the intermediate code data from the intermediate buffer 33*b*, develops the intermediate code data into dot pattern data with reference to the tone data in the ROM 34, and stores the dot pattern data in the output buffer 33*c*.

The dot pattern data is data for associating each of grid points of a dot pattern grid with the tone (pattern of a drive pulse) of a dot. Specifically, the dot pattern data is data in which each of positions (grid points of a dot pattern grid) of a two-dimensional plane (ejection surface 6*a*) is associated with a two-bit value ("00," "01," "10," or "11"). Note that the dot pattern grid is a grid that defines the tones of dots and has minimum intervals.

When the control unit 32 develops dot pattern data corresponding to one travel motion of the substrate stage 13, uses the dot pattern data to generate serial data synthesized with transfer clocks SCLK, and serial-transfers the serial data to the head drive circuits 41 via the internal I/F 39. Upon serial-transferring the dot pattern data for such one travel motion, the control unit 32 erases the contents of the intermediate buffer 33*b* to develop subsequent intermediate code data.

Hereafter, serial data generated using dot pattern data will be referred to as serial pattern data SIA. The serial pattern data SIA is generated for each of cells of the dot pattern grid arranged along the travel direction.

In FIG. 9, the serial pattern data SIA has a two-bit value for selecting the tone of a dot by the number (180) of the nozzles N. The serial pattern data SIA includes higher-order select data SIH of 180 bits that is made up of the higher-order bits of the two-bit values for selecting the tones of dots and lower-order select data SIL of 180 bits that is made up of the lower-order bits thereof. Besides the higher-order select data SIH and the lower-order select data SIL, the serial pattern data SIA includes pattern data SP.

The pattern data SP is data of 32 bits obtained by associating each of four values determined by the higher-order select data SIH and the lower-order select data SIL with data of 8 bits (each switch data Pnm (nm=00 to 03, 10 to 13, . . . , 70 to 73). Each switch data Pnm (nm=00 to 03, 10 to 13, . . . , 70 to 73) is data for setting on/off of each piezoelectric element PZ.

In FIG. 10, the STATE switch signals CHA are pulse signals generated at the ejection frequency of droplets D. The "STATE" here refers to a state of the STATE switch signal CHA set for each pulse. The state of the STATE switch signal CHA in a period from when a preceding latch signal LATA for pattern data is generated until when a following latch signal LATA for pattern data is generated is categorized into multiple STATE (for example, STATES of '0'to '7'). The period from when a preceding latch signal LATA for pattern data is generated until when a following latch signal LATA for pattern data is generated corresponds to a period in which each nozzle N faces a cell of the dot pattern grid.

The control unit 32 associates each data (each switch data Pnm) of the pattern data SP with each STATE via the head drive circuits 41 according to a truth table shown in FIG. 10. For example, the control unit 32 associates a nozzle N (piezoelectric element PZ) having higher-order select data SIH "0" and lower-order select data "0" with switch data P00, P10, . . . , P70 via the head drive circuits 41. Then, the control unit 32 associates the switch data P00, P10, . . . , P70 with the STATES '0' to '7'. Then, the control unit 32 supplies a drive waveform signal COM to the corresponding piezoelectric element PZ in the STATES of the switch data P00 to P70 set to "1" via the head drive circuits 41. For example, if P00 to P60 are set to "0" and P70 is set to "1", the control unit 32 turns off the piezoelectric element PZ during the STATES '0' to '6' and turns on the piezoelectric element PZ when the STATE becomes '7.'

Similarly, the control unit 32 associates a nozzle N (piezoelectric element PZ) having higher-order select data SIH "0" and lower-order select data "1," a nozzle N (piezoelectric element PZ) having higher-order select data SIH "1" and lower-order select data "0," and a nozzle N (piezoelectric element PZ) having higher-order select data SIH "1" and lower-order select data "1," with switch data P01 to P71, switch data P02 to P72, and switch data P03 to P73, respectively. Then, the control unit 32 associates each of the switch data P01 to P71, the switch data P02 to P72, and the switch data P03 to P73 with the STATES '0' to '7.' Then, the control unit 32 supplies drive waveform signals COM to the corresponding piezoelectric elements PZ in the STATES of the switch data P01 to P71, the switch data P02 to P72, and the switch data P03 to P73 set to "1" via the head drive circuit 41.

Thus, each time serial pattern data SIA is generated, all the nozzles N each realize a dot tone (that is, a pattern of a drive pulse) selected by the corresponding higher-order select data SIH and the lower-order select data SIL with respect to the corresponding grid cell.

In FIG. 6, the control unit 32 temporarily stores the drawing data Ip received by the external I/F 31 in the reception buffer 33*a*. Then the control unit 32 converts the drawing data Ip into an intermediate code and stores the intermediate code in the intermediate buffer 33*b* as intermediate code data. Then the control unit 32 reads the intermediate code data from the intermediate buffer 33*b*, develops the intermediate code data into common select data with reference to the rank data in the ROM 34, and stores the common select data in the output buffer 33*c*.

The common select data is data in which each of grid points of the dot pattern grid is associated with a two-bit value ("00," "01," "10," or "11"). Also, the common select data is data for associating each of the four values with any one of first to fourth drive waveform signals COMA, COMB, COMC, and COMD.

Upon obtaining the common select data corresponding to one travel motion of the substrate stage 13, the control unit 32 uses the common select data to generate serial data synthesized with transfer clocks SCLK, and serial-transfers the serial data to the head drive circuits 41 via the internal I/F 39. Upon serial-transferring the common select data for such one travel motion, the control unit 32 erases the contents of the intermediate buffer 33*b* to develop subsequent intermediate code data.

Hereafter, serial data generated using common select data will be referred to as serial common select data SIB. As with serial pattern data SIA, serial common select data SIB is generated for each of cells of the dot pattern grid arranged along the travel direction.

In FIG. 11, serial common select data SIB includes higher-order select data SXH of 180 bits that is made up of the higher-order bits of the two-bit values for setting the types of drive waveform signals COM and lower-order select data SXL of 180 bits that is made up of the lower-order bits thereof, and control data CR.

Higher-order select data SXH and lower-order select data SXL is data for associating each of the nozzles N to the type of a drive waveform signal COM according to a truth table shown in FIG. 12.

Using higher-order select data SXH and lower-order select data SXL, the control unit 32 associates each of the 180 nozzles N (piezoelectric elements PZ) with the type of a drive waveform signal COM via the head drive circuits 41 according to the truth table shown in FIG. 12. For example, the control unit 32 associates each of nozzles N having higher-order select data SXH "0" and lower-order select data SXL "0" with a first drive waveform signal COMA via the head drive circuits 41. The control unit 32 associates each of nozzles N having higher-order select data SXH "0" and lower-order select data SXL "1," each of nozzles N having higher-order select data SXH "1" and lower-order select data SXL "0," and each of nozzles N having higher-order select data SXH "1" and lower-order select data SXL "1" with a second drive waveform signal COMB, a third drive waveform signal COMC, and a fourth drive waveform signal COMD, respectively.

Control data CR is data for causing the head drive circuits 41 to perform various types of control, such as data for causing the head drive circuits 41 to drive temperature detection circuits provided in the head drive circuits 41. The control unit 32 detects the temperatures of the ejection heads 18 via the head drive circuits 41 according to the control data CR.

The head drive circuits 41 will now be described.

Figure 13:
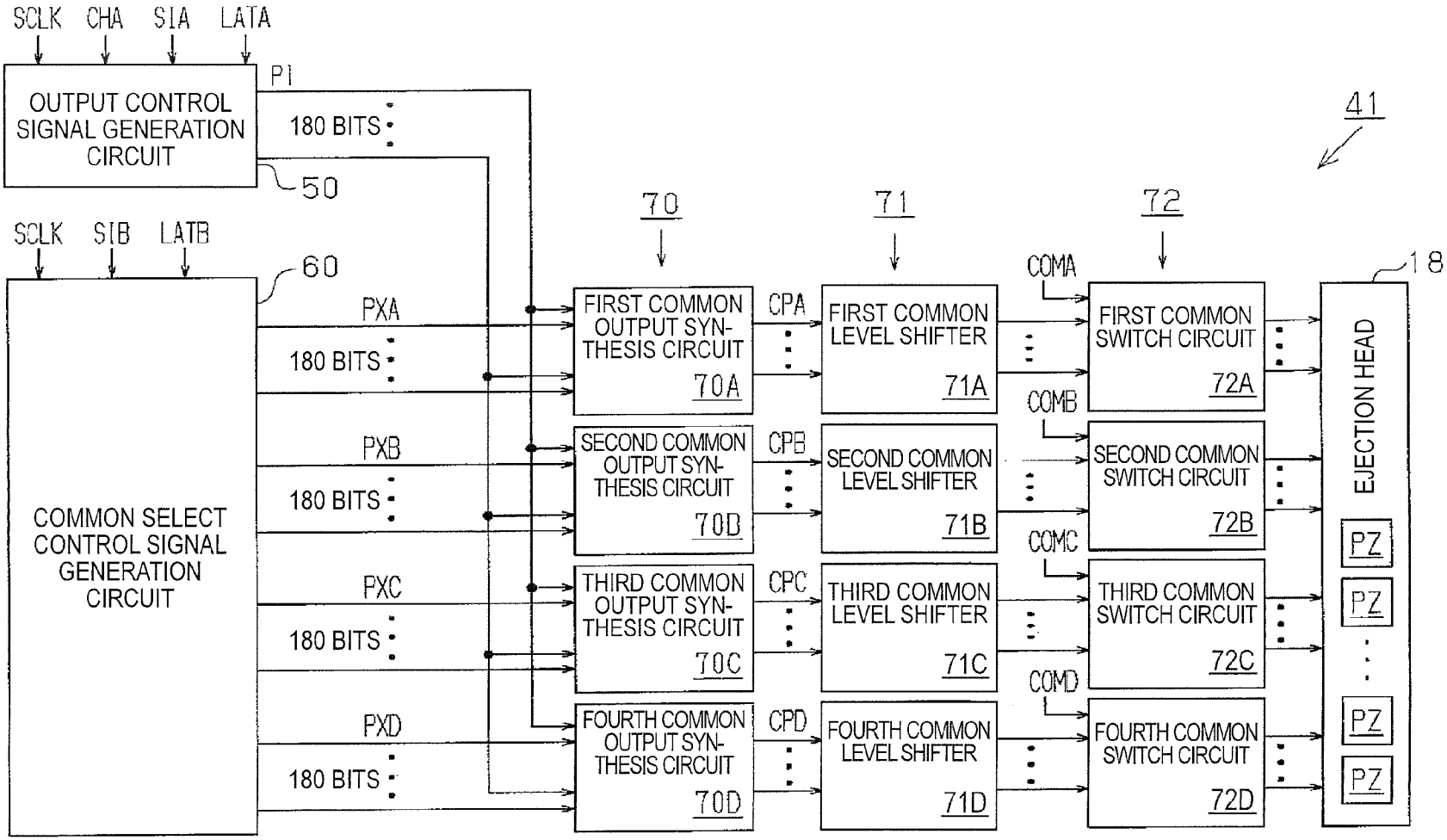
FIG. 13 is an electrical block circuit diagram showing a head drive circuit according to this embodiment.

As shown in FIG. 13, each head drive circuit 41 includes an output control signal generation circuit 50 serving as an output control signal generator and a common select control signal generation circuit 60 serving as a common select control signal generator. Each head drive circuit 41 also includes an output synthesis circuit 70 (first to fourth common output synthesis circuits 70A, 70B, 70C, 70D) and a level shifter 71 (first to fourth common level shifters 71A, 71B, 71C, 71D) for raising the voltage of a logic signal to the drive voltage of an analog switch. The head drive circuit 41 further includes a switch circuit 72 including four systems (first to fourth common switch circuits 72A, 72B, 72C, 72D) having analog switches for providing piezoelectric elements PZ to the corresponding drive waveform signals COM. The above-mentioned output synthesis circuit 70, the level shifter 71, and the switch circuit 72 constitutes an output unit.

First, the output control signal generation circuit 50 for generating output control signals PI will be described.

Figure 14:
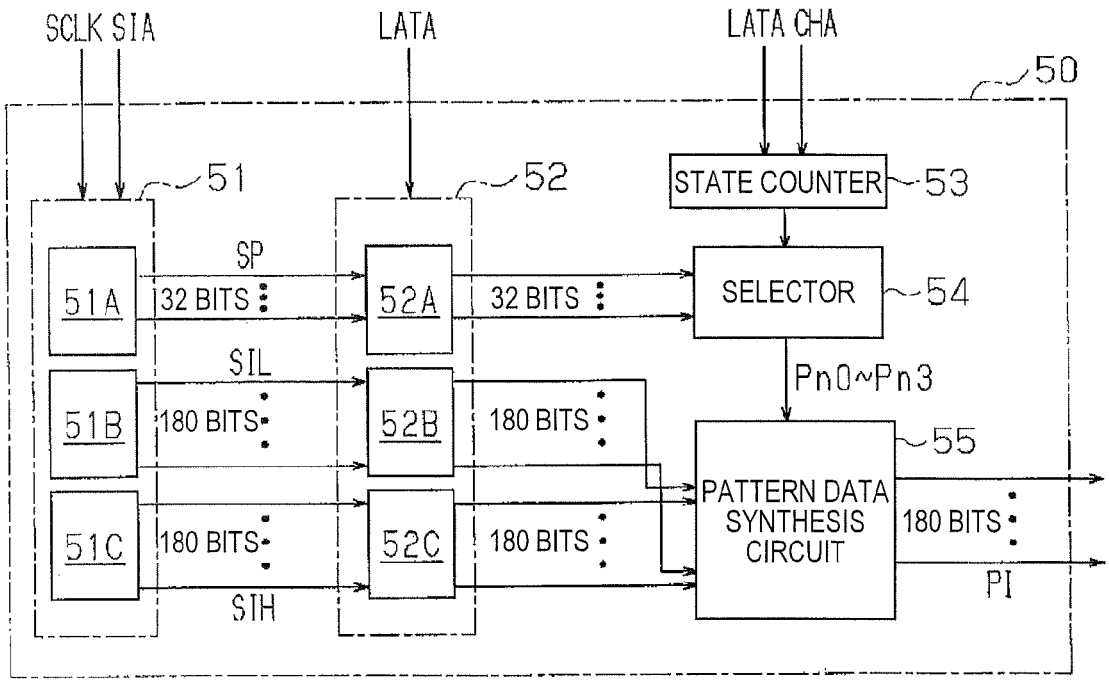
FIG. 14 is an electrical block circuit diagram showing an output control signal generation circuit according to this embodiment.

In FIG. 14, the output control signal generation circuit 50 includes a shift register 51, a latch 52, a STATE counter 53, a selector 54, and a pattern data synthesis circuit 55.

The shift register 51 includes a pattern data register 51A, a lower-order select data register 51B, and a higher-order select data register 51C, and receives serial pattern data SIA and transfer clocks SCLK from the control device 30.

Pattern data SP of serial pattern data SIA is serial-transferred to the pattern data register 51A and sequentially shifted according to transfer clocks SCLK. Thus, the pattern data SP of 32 bits is stored in the register 51A. Lower-order select data SIL of serial pattern data SIA is serial-transferred to the lower-order select data register 51B and sequentially shifted according to transfer clocks SCLK. Thus, the lower-order select data SIL of 180 bits is stored in the register 51B. Higher-order select data SIH of serial pattern data SIA is serial-transferred to the higher-order select data register 51C and sequentially shifted according to the transfer clock SCLK. Thus, the higher-order select data SIH of 180 bits is stored in the register 51C.

The latch 52 includes a pattern data latch 52A, a lower-order select data latch 52B, and a higher-order select data latch 52C, and receives a latch signal LATA for pattern data from the control device 30.

Upon receipt of a latch signal LATA for pattern data, the pattern data latch 52A latches the data stored in the pattern data register 51A, that is, the pattern data SP. Upon receipt of the latch signal LATA for pattern data, the lower-order data latch 52B latches the data stored in the lower-order select data register 51B, that is, the lower-order select data SIL. Upon receipt of the latch signal LATA for pattern data, the higher-order data latch 52C latches the data stored in the higher-order select data register 51C, that is, the higher-order select data SIH.

The STATE counter 53 is a counter circuit of 3 bits, and counts the STATE according to the rising edge of a STATE switch signal CHA, thereby changing the STATE. The STATE counter counts from STATE '0' to STATE '7' and then, upon receipt of the STATE switch signal CHA, returns to STATE '0.' When the LATA signal becomes the "H" level (high potential), the STATE counter 53 is reset, returning to STATE "0." Upon receipt of a STATE switch signal CHA and a latch signal LATA for pattern data from the control device 30, the STATE counter 53 counts the value of the STATE and outputs the counted STATE value to the selector 54.

The selector 54 selects switch data Pn0 to Pn3 corresponding to the STATE value according to the STATE value outputted from the STATE counter 53 and the pattern data SP latched by the pattern data latch 52A. Then, the selector 54 outputs the selected switch data Pn to Pn3 to the pattern data synthesis circuit 55. That is, when the latch signal LATA for pattern data is inputted to the pattern data latch 52A, the selector 54 reads the pattern data SP latched by the pattern data latch 52A, and selects switch data Pn0 to Pn3 corresponding to the value 'n' of the STATE according to the truth table shown in FIG. 10. For example, when the STATE of the STATE counter 53 is '0,' the selector 54 outputs the pattern data SP corresponding to the state '0,' that is, switch data P00 to P03 shown in FIG. 10, to the pattern data synthesis circuit 55.

The pattern data synthesis circuit 55 receives the switch data Pn0 to Pn3 from the selector 54 and reads the lower-order select data SIL latched by the lower-order select data latch 52B and the higher-order select data SIH latched by the higher-order data latch 52C. Using the switch data Pn0 to Pn3, the lower-order select data SIL, and the higher-order select data SIH, the pattern data synthesis circuit 55 generates data (output control signal PI) of 180 bits that sets the ejection/non-ejection (the value of each bit: "0" or "1") of a droplet D with respect to the 180 nozzles N with for each STATE according to the truth table shown in FIG. 10.

Figure 15:
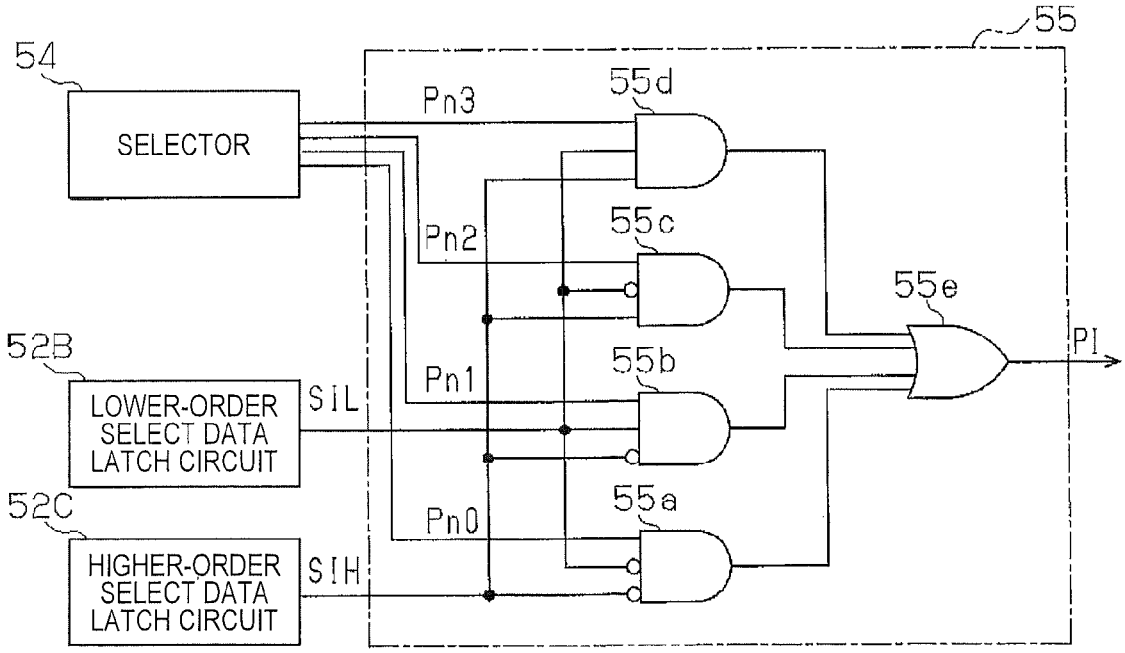
FIG. 15 is a circuit diagram showing a pattern data synthesis circuit according to this embodiment.

For example, as shown in FIG. 15, the pattern data synthesis circuit 55 includes four AND gates 55*a*, 55*b*, 55*c*, and 55*d* corresponding to one nozzle N, and an OR gate 55*e* that receives outputs of the AND gates 55*a*, 55*b*, 55*c*, and 55*d*. The AND gates 55*a*, 55*b*, 55*c*, and 55*d* each receive higher-order select data SIH, lower-order select data SIL, and the corresponding switch data Pn0 to Pn3. If the higher-order select data SIH and the lower-order select data SIL is "0" and "0," only the AND gate 55*a* is enabled and switch data Pn0 ("0" or "1") is outputted as the output control signal PI for the corresponding nozzle N. If the higher-order select data SIH and the lower-order select data SIL is "0" and "1," only the AND gate 55*b* is enabled and switch data Pn1 ("0" or "1") is outputted as the output control signal PI for the corresponding nozzle N. If the higher-order select data SIH and the lower-order select data SIL is "1" and "0," only the AND gate 55*c* is enabled, and switch data Pn2 ("0" or "1") is outputted as the output control signal PI for the corresponding nozzle N. If the higher-order select data SIH and the lower-order select data SIL is "1" and "1," only the AND gate 55*d* is enabled, and switch data Pn3 ("0" or "1") is outputted as the output control signal IP for the corresponding nozzle N. Thus, switch data Pnm corresponding to the truth table shown in FIG. 10 is outputted as an output control signal PI.

The common select control signal generation circuit 60 for generating common select control signals PXA, PXB, PXC, and PXD will now be described.

Figure 16:
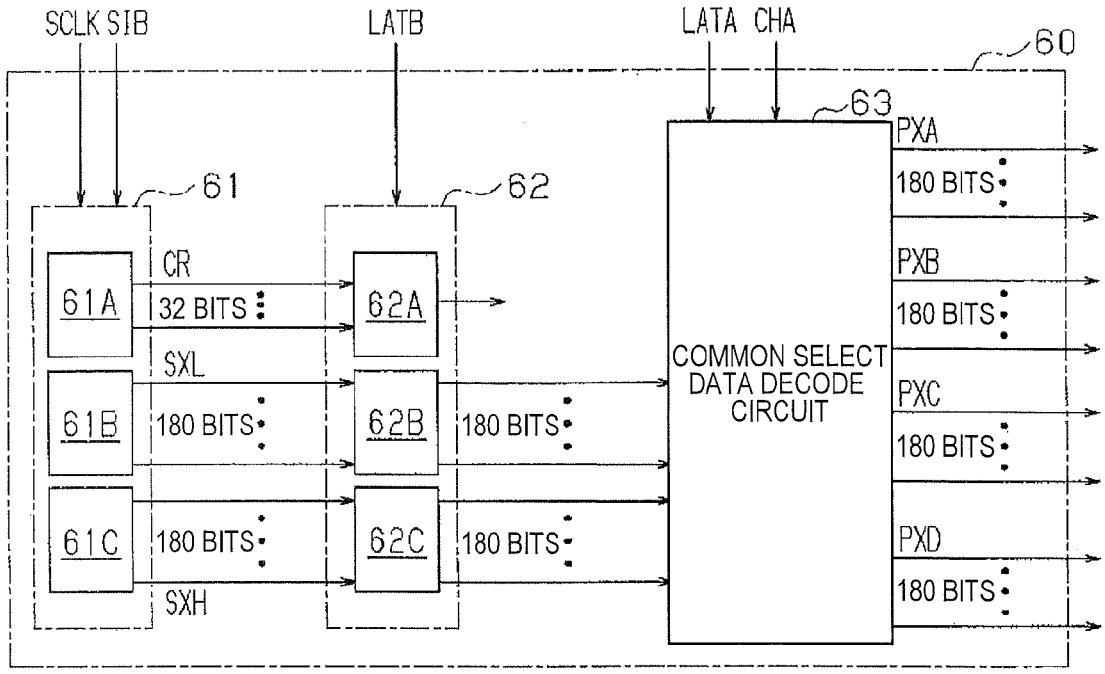
FIG. 16 is a circuit diagram showing a common select control signal generation circuit according to this embodiment.

In FIG. 16, the common select control signal generation circuit 60 includes a shift register 61, a latch 62, and a common select data decode circuit 63.

The shift register 61 includes a control data register 61A, a lower-order select data register 61B, and a higher-order select data register 61C, and receives serial common select data SIB and transfer clocks SCLK from the control device 30.

Control data CR of the serial common select data SIB is serial-transferred to the control data register 61A and sequentially shifted according to the transfer clocks SCLK. Thus, the control data CR of 32 bits is stored in the register 61A. Lower-order select data SXL of the serial common select data SIB is serial-transferred to the lower-order select data register 61B and sequentially shifted according to the transfer clocks SCLK. Thus, the lower-order select data SXL of 180 bits is stored in the register 61B. Higher-order select data SXH of the serial common select data SIB is serial-transferred to the higher-order select data register 61C and sequentially shifted according to the transfer clocks SCLK. Thus, the higher-order select data SXH of 180 bits is stored in the register 61C.

The latch 62 includes a control data latch 62A, a lower-order select data latch 62B, and a higher-order select data latch 62C, and receives a latch signal LATB for common select data from the control device 30.

Upon receipt of the latch signal LATB for common select data, the control data latch 62A latches the data stored in the control data register 61A, that is, the control data CR and outputs the latched data in a predetermined control circuit (e.g., a temperature detection circuit, etc.). Upon receipt of the latch signal LATB for common select data, the lower-order select data register 62B latches the data stored in the lower-order select data register 61B, that is, the lower-order select data SXL. Upon receipt of the latch signal LATB for common select data, the higher-order select data register 62C latches the data stored in the higher-order select data register 61C, that is, the higher-order select data SXH.

The common select data decode circuit 63 reads the lower-order select data SXL latched by the lower-order select data latch 62B and the higher-order select data SXH latched by the higher-order data latch 62C. Using the lower-order select data SXL and the higher-order select data SXH, the common select data decode circuit 63 determines whether each of four different drive waveform signals COM is used or not (selected or not selected) according to the truth table shown in FIG. 12. Then the common select data decode circuit 63 generates data determining the selection/non-selection of each drive waveform signal COM with respect to each of the 180 nozzles N.

Hereafter, data that determines the selection/non-selection of a first drive waveform signal COMA will be referred to as a first common select control signal PXA. Data that determines the selection/non-selection of a second drive waveform signal COMB, data that determines the selection/non-selection of a third drive waveform signal COMC, and data that determines the selection/non-selection of a fourth drive waveform signal COMD will be referred to as a second common select control signal PXB, a third common select control signal PXC, and a fourth common select control signal PXD.

Figure 17:
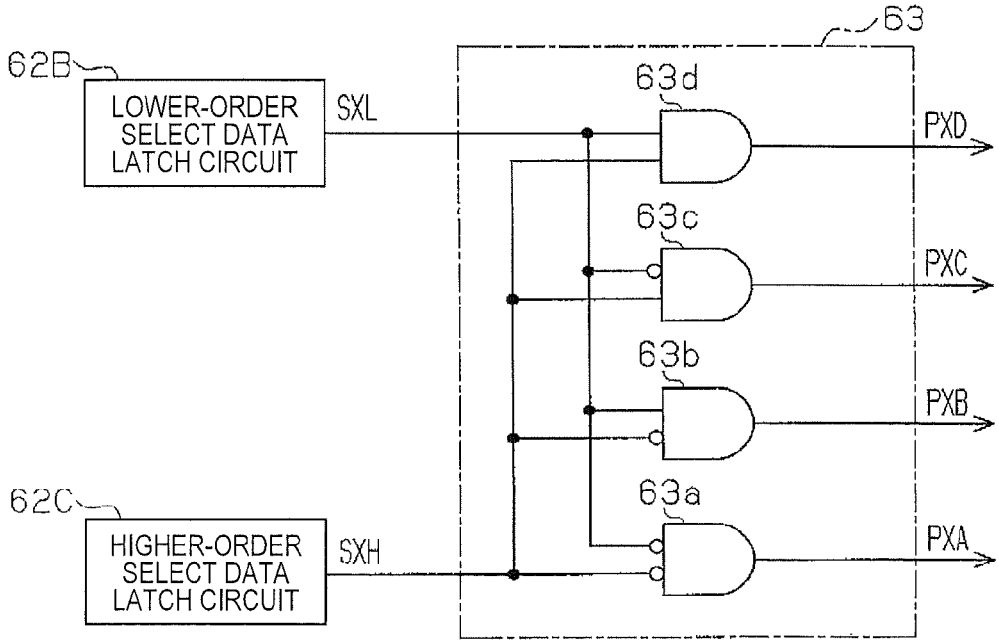
FIG. 17 is a circuit diagram showing a common select data decode circuit according to this embodiment.

For example, as shown in FIG. 17, the common select data decode circuit 63 includes four AND gates 63*a*, 63*b*, 63*c*, and 63*d* corresponding to one nozzle N. The AND gates 63*a*, 63*b*, 63*c*, and 63*d* each receive higher-order select data SXH and lower-order select data SXL. If the higher-order select data SXH and the lower-order select data SXL is "0" and "0," respectively, only the AND gate 63*a* is enabled and the first common select control signal PXA for the corresponding nozzle N is outputted as "1" and the other second to fourth common select control signals PXB, PXC, and PXD are each outputted as "0." If the higher-order select data SXH and the lower-order select data SXL is "0" and "1," respectively, only the AND gate 63*b* is enabled and the second common select control signal PXB for the corresponding nozzle N are outputted as "1." If the higher-order select data SXH and the lower-order select data SXL is "1" and "0," respectively, only the AND gate 63*c* is enabled and the third common select control signal PXC for the corresponding nozzle N is outputted as "1." If the higher-order select data SXH and the lower-order select data SXL is "1" and "1," respectively, only the AND gate 63*d* is enabled and the fourth common select control signal PXD for the corresponding nozzle N are outputted as "1." Thus, the first to fourth common select control signals PXA, PXB, PXC, and PXD corresponding to the truth table shown in FIG. 12 are outputted.

In FIG. 13, the output synthesis circuit 70 includes a first common output synthesis circuit 70A, a second common output synthesis circuit 70B, a third common output synthesis circuit 70C, and a fourth common output synthesis circuit 70D. The first to fourth common output synthesis circuits 70A, 70B, 70C, and 70D commonly receive an output control signal PI of 180 bits from the output control generation circuit 50. Also, the first to fourth common output synthesis circuits 70A, 70B, 70C, and 70D receive a first common select control signal PXA, a second common select control signal PXB, a third common select control signal PXC, and a fourth common select control signal PXD, respectively, from the common select control signal generation circuit 60.

The first to fourth common output synthesis circuits 70A, 70B, 70C, and 70D each include an AND gate corresponding to each nozzle N. The AND gates of the first common output synthesis circuit 70A each receive the corresponding output control signal PI and the corresponding first common select control signal PXA. Also, the AND gates of the first common output synthesis circuit 70A each output a signal (first selection common output control signal CPA) that determines whether to supply (supply/non-supply) a first drive waveform signal COMA to the corresponding piezoelectric element PZ. The AND gates of the second common output synthesis circuit 70B each receive the corresponding output control signal PI and the corresponding second common select control signal PXB. Also, the AND gates of the second common output synthesis circuit 70B each output a signal (second selection common output control signal CPB) that determines whether to supply (supply/non-supply) a second drive waveform signal COMB to the corresponding piezoelectric element PZ. The AND gates of the third common output synthesis circuit 70C each receive the corresponding output control signal PI and the corresponding third common select control signal PXC. Also, the AND gates of the third common output synthesis circuit 70C each output a signal (third selection common output control signal CPC) that determines whether to supply (supply/non-supply) a third drive waveform signal COMC to the corresponding piezoelectric element PZ. The AND gates of the fourth common output synthesis circuit 70D each receive the corresponding output control signal PI and the corresponding fourth common select control signal PXD. Also, the AND gates of the fourth common output synthesis circuit 70D each output a signal (fourth selection common output control signal CPD) that determines whether to supply (supply/non-supply) a fourth drive waveform signal COMD to the corresponding piezoelectric element PZ.

For example, if the output control signal PI is "1" and the first common select control signal PXA is "1," the first common output synthesis circuit 70A outputs a first selection common output control signal CPA (a signal whose bit value is "1") for providing a first drive waveform signal COMA to the corresponding piezoelectric element PZ. If the output control signal PI is "0" or the first common select control signal PXA is "0," the first common output synthesis circuit 70A outputs a first selection common output control signal CPA (a signal whose bit value is "0") for not providing a first drive waveform signal COMA to the corresponding piezoelectric element PZ.

Thus, with respect to each of the 180 nozzles N (piezoelectric elements PZ), the ejection/non-ejection of a droplet D is determined according to the corresponding output control signal PI, and the supply/non-supply of each drive waveform signal COM is determined according to the first to fourth selection control signals PXA, PXB, PXC, and PXD.

The level shifter 71 includes four systems (a first common level shifter 71A, a second common level shifter 71B, a third common level shifter 71C, and a fourth common level shifter 71D). The first to fourth common level shifter 71A, 71B, 71C, and 71D receive the first to fourth common output control signals CPA, CPB, CPC, and CPD, respectively, from the first to fourth common output synthesis circuits 70A, 70B, 70C, and 70D, respectively. Also, the first to fourth common level shifter 71A, 71B, 71C, and 71D raise the voltages of the first to fourth common output control signals CPA, CPB, CPC, and CPD, respectively, to the drive voltages of the analog switches, and output open/close signals corresponding to the 180 piezoelectric elements PZ.

The switch circuit 72 includes four systems (a first common switch circuit 72A, a second common switch circuit 72B, a third common switch circuit 72C, and a fourth common switch circuit 72D) for the first to fourth drive waveform signals COMA, COMB, COMC, and COMD. The first to fourth common switch circuits 72A, 72B, 72C, and 72D each include 180 analog switches corresponding to the piezoelectric elements PZ. Also, the first to fourth common switch circuits 72A, 72B, 72C, and 72D receive the open/close signals from the first to fourth level shifters 71A, 71B, 71C, and 71D, respectively. The input terminals of the analog switches of the four systems receive the corresponding drive waveform signals COM, and the output terminals thereof are commonly coupled to the piezoelectric elements PZ. Each of the analog switches receives an open/close signal from the corresponding shifter 71, and outputs the corresponding drive waveform signal to the corresponding piezoelectric element PZ when the open/close signal is the "H" level.

Thus, when the ejection of a droplet D is selected according to the corresponding output control signal PI with respect to particular ones of the 180 nozzles N (piezoelectric elements PZ), any one of the first to fourth drive waveform signals COMA, COMB, COMC, and COMD is provided to each of the particular nozzles N (piezoelectric elements PZ) according to the first to fourth selection common output control signals CPA, CPB, CPC, and CPD. In other words, when the ejection of a droplet D is selected with respect to particular ones of the 180 nozzles N (piezoelectric elements PZ), drive waveform signals COM according to the ranks are provided to the particular nozzles N (piezoelectric elements PZ).

Figure 18:
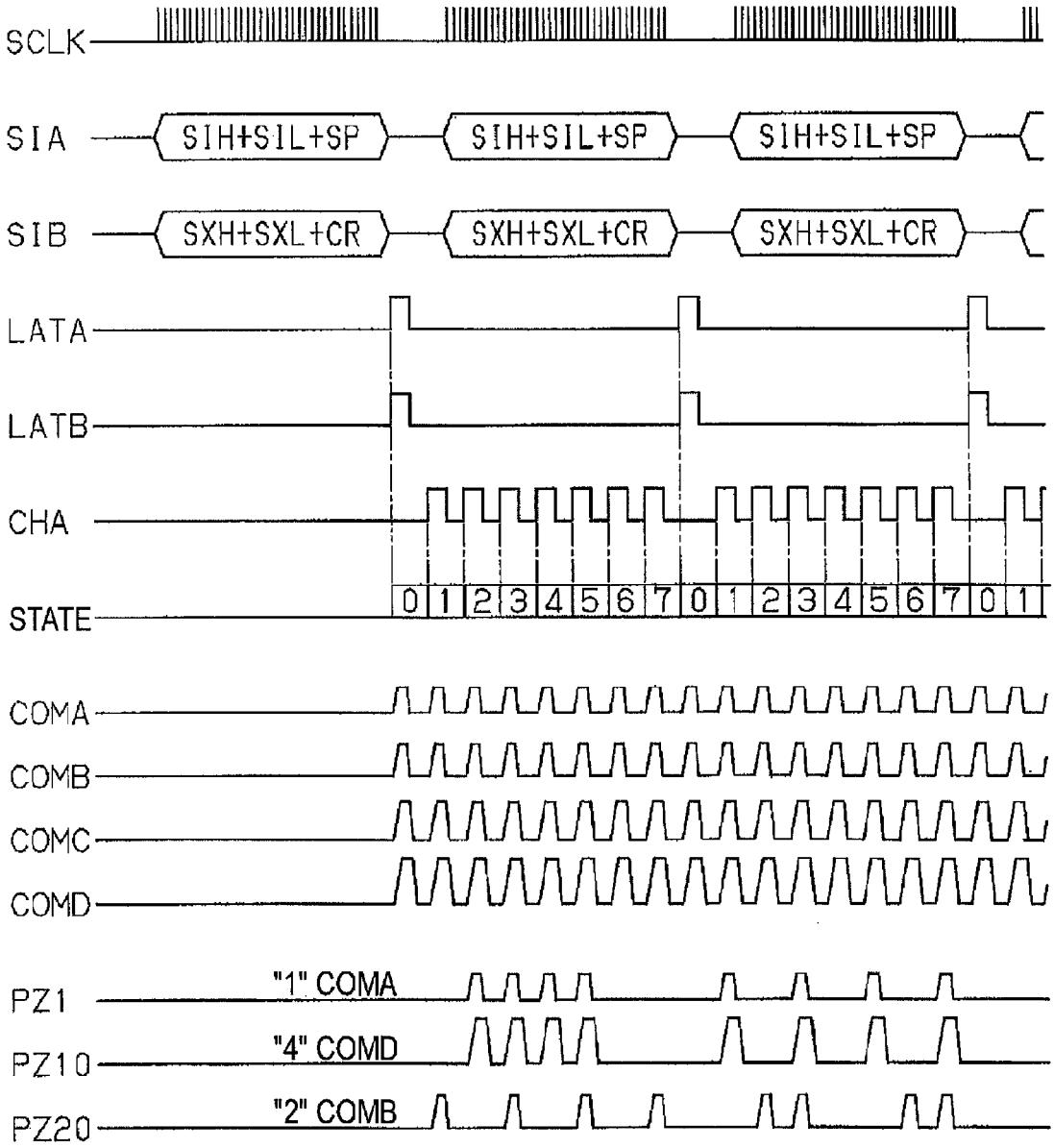
FIG. 18 is a timing chart showing the drive timings of the head drive circuit.

A method for driving the droplet ejection heads 18 mounted on the droplet ejection device 10 will now be described. FIG. 18 is a timing chart showing drive waveform signals COM to be provided to the piezoelectric elements PZ.

First, as shown in FIG. 3, the color filter substrate 6 is placed on the substrate stage 13 with the ejection surface 6*a* upward. In this case, the color filter substrate 6 is placed on the substrate stage 13 in the anti-Y arrow direction of the carriage 17. From this state, the input/output device 40 inputs drawing data Ip, reference drive voltage data Iv, and head data Ih to the control device 30. The reference drive voltage data Iv and the head data Ih is data generated according to the actual weights Iw of droplets D measured by the droplet weight device 23.

In this case, the head data Ih categorizes a nozzle N (first piezoelectric element PZ1) positioned most forward in the X arrow direction into the rank "1," the tenth nozzle N (tenth piezoelectric element PZ10) from the most forward nozzle in the X arrow direction into the rank "4," and the twentieth nozzle N (twentieth piezoelectric element PZ20) from the most forward nozzle in the X arrow direction into the rank "2."

The control device 30, via the motor drive circuit 38, causes the carriage 17 to travel and disposes the carriage 17 so that each ejection head 18 passes above the color filter substrate 6 when the color filter substrate 6 travels in the Y arrow direction. Upon disposing the carriage 17, the control device 30, via the motor drive circuit 38, begins to cause the substrate stage 13 to travel.

The control device 30 develops the drawing data Ip inputted from the input/output device 40 into dot pattern data. As shown in FIG. 18, upon developing dot pattern data corresponding to one travel motion of the substrate stage 13, the control device 30 uses the dot pattern data to generate serial pattern data SIA, synthesizes the serial pattern data SIA with transfer clocks SCLK, and serial-transfers the serial pattern data SIA to the head drive circuits 41. The control device 30 also develops the head data Ih inputted from the input/output device 40 into common select data. As shown in FIG. 18, upon developing common select data corresponding to one travel motion of the substrate stage 13, the control device 30 uses the common select data to generate serial common select data SIB, synthesizes the serial common select data SIB with transfer clocks SCLK, and serial-transfers the serial common select data SIB to the head drive circuits 41.

As shown in FIG. 18, when the substrate stage 13 reaches a predetermined drawing start position, the control device 30 outputs a latch signal LATA for pattern data and a latch signal LATB for common select data to the head drive circuits 41 so that the head drive circuits 41 latch the serial pattern data SIA and the serial common select data SIB.

Once the head drive circuits 41 have latched the serial pattern data SIA and the serial common select data SIB, the control device 30 outputs a STATE switch signal CHA to the head drive circuits 41 so that the STATE is sequentially switched from '0' to '1,' '2,' '3,' . . . , '7.' In this case, the control device 30 refers to the reference drive voltage signal Iv to cause the drive waveform generation circuit 36 to generate four types of drive waveform signals COM (a first drive waveform signal COMA, a second drive waveform signal COMB, a third drive waveform signal COMC, and a fourth drive waveform signal COMD). Then, the control device 30 synthesizes each of the first to fourth drive waveform signals COMA, COMB, COMC, and COMD with the latch signal LATA for pattern data and the STATE switch signal CHA and outputs these drive waveform signals one after another to the head drive circuits 41.

Upon latching the serial pattern data SIA, the head drive circuits 41 associate each data included in the pattern data SP with each STATE according to the higher-order select data SIH and the lower-order select data SIL and the truth table shown in FIG. 10 in order to determine the ejection/non-ejection in each STATE with respect to each of the 180 nozzles N (piezoelectric elements PZ). For example, as shown in FIG. 18, the head drive circuits 41 cause the first and tenth piezoelectric elements PZ1 and PZ10 to select the ejection of a droplet D in the states of '2,' '3,' '4,' and '5.' It causes the twentieth piezoelectric element PZ20 to select the ejection of a droplet D in the states of '1,' '3,' '5,' and '7.'

As a result, each nozzle N is driven according to the pattern of a desired drive pulse so as to form a dot having a desired tone.

Also, upon latching the serial common select data SIB, the head drive circuits 41 determine the type of a drive waveform signal COM with respect to each of the 180 nozzles N (piezoelectric elements PZ) according to the higher-order select data SXH and the lower-order select data SXL and the truth table shown in FIG. 12.

The first piezoelectric element PZ1 set to the rank "1" is associated with the first drive waveform signal COMA according to the truth table shown in FIG. 12 because the corresponding higher-order select data SXH and lower-order select data SXL is "0" and "0," respectively. That is, a first drive waveform signal COMA corresponding to the rank "1" is provided to the first piezoelectric element PZ1 categorized into the rank "1." The tenth piezoelectric element PZ10 set to the rank "4" is associated with the fourth drive waveform signal COMD according to the truth table shown in FIG. 12 because the corresponding higher-order select data SXH and lower-order select data SXL is "1" and "1," respectively. That is, a fourth drive waveform signal COMD corresponding to the rank "4" is provided to the tenth piezoelectric element PZ10 categorized into the rank "4." The twentieth piezoelectric element PZ20 set to the rank "2" is associated with the second drive waveform signal COMB according to the truth table shown in FIG. 12 because the corresponding higher-order select data SXH and lower-order select data SXL is "0" and "1," respectively. That is, a second drive waveform signal COMB corresponding to the rank "2" is provided to the twentieth piezoelectric element PZ20 categorized into the rank "2."

As a result, all the nozzles N that eject droplets D receive drive waveform signals COM corresponding to the ranks thereof to eject droplets D with a common reference weight.

The advantages of this embodiment configured as described above will now be described.

(1) According to the above-mentioned embodiment, each of the multiple nozzles N are associated with the ranks "1" to "4" corresponding to the weights of droplets D ejected from these nozzles N. Further, drive waveform signals COM (first drive waveform signals COMA, second drive waveform signals COMB, third drive waveform signals COMC, and fourth drive waveform signals COMD) corresponding to these ranks are generated so that the actual weights Iw of droplets D to be ejected become a predetermined reference weight. Then, the piezoelectric elements PA corresponding to the nozzles N selected according to the drawing data receive drive waveform signals COM corresponding to the ranks of the selected nozzles N so that droplets D with the reference weight are ejected from these nozzles N onto the ejection surface.

Therefore, the nozzles N selected according to the drawing data Ip receive the drive waveform signals COM corresponding to the ranks set thereto to eject droplets D with the predetermined reference weight. As a result, the weights of droplets D to be ejected from the multiple nozzles N are standardized to the predetermined reference weight according to the drive waveform signals COM corresponding to the ranks. Thus, the weights of droplets D are corrected for each nozzle N, thereby improving the uniformity in film thickness of the color filter CF.

(2) According to the above-mentioned embodiment, the common select data (serial common select data SIB) is generated, and all the 180 nozzles N are associated with drive waveform signals COM corresponding to the ranks thereof for each STATE. Further, the pattern data (serial pattern data SIA) is generated, and the ejection/non-ejection of a droplet D is set with respect to all the 180 nozzles N for each STATE. As a result, the nozzles N that eject droplets D are more reliably driven according to drive waveform signals COM corresponding to the rank thereof.

(3) Further, the ejection/non-ejection of a droplet D is set with respect to all the nozzles N for each STATE, and these nozzles are associated with drive waveform signals COM corresponding to the ranks thereof. Therefore, whenever the nozzles N eject droplets D, they receive drive waveform signals COM corresponding to the rank thereof. As a result, the weights of all droplets D to be ejected are more reliably standardized to the reference weight.

(4) According to the above-mentioned embodiment, the droplet ejection device 10 includes the droplet weight device 23 for measuring the weights of droplets D. This allows the weights of droplets D to be measured in the environment where the droplets have been ejected. Therefore, more correct actual weights Iw are obtained compared with a case in which the weights of droplets are measured by an external device. As a result, the actual weights Iw of droplets D are more correctly standardized to the reference weight.

The above-mentioned embodiment may be modified as follows.

In the above-mentioned embodiment, the control device 30 transfers serial common select data SIB each time it transfers serial pattern data SIA. Also, first to fourth common select control signals PXA, PXB, PXC, and PXD for determining the selection/non-selection of drive waveform signals COM are generated each time an output control signal PI for setting the ejection/non-ejection of droplets D is generated.

Figure 19:
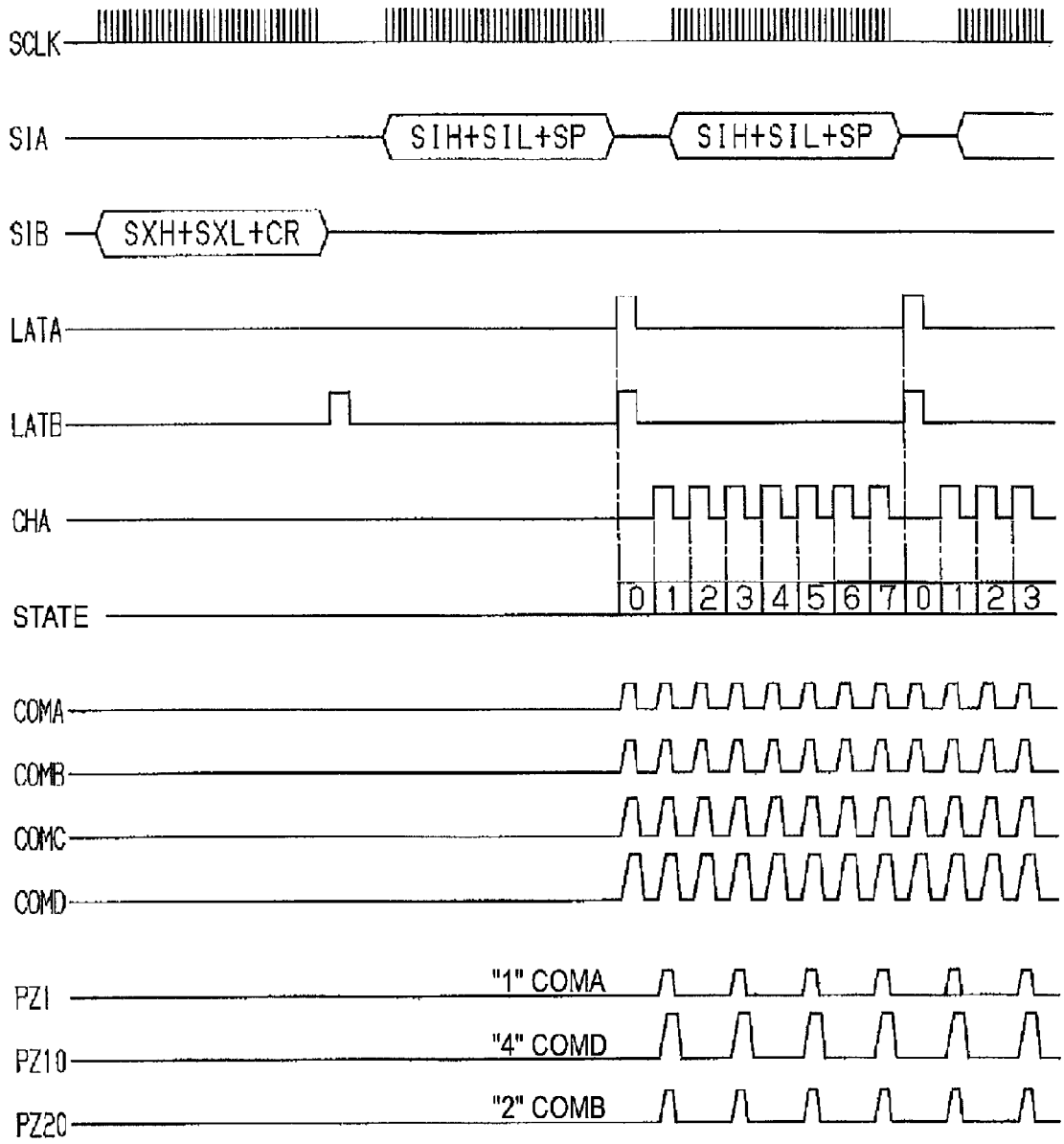
FIG. 19 is a timing chart showing the drive timings of the head drive circuit according to a modification of this embodiment.

Without being limited to this, for example as shown in FIG. 19, the control device 30 may transfer only the serial common select data SIB in advance and store higher-order select data SXH, lower-order select data SXL, and control data CR in the common select control signal generation circuit 60 (lower-order select data latch 62B and higher-order select data latch 62C). Further, each time the head drive circuits 41 latch the serial pattern data SIA to generate an output control signal PI, the control device 30 uses the higher-order select data SXH and the lower-order select data SXL stored in advance to generate first to fourth common select control signals PXA, PXB, PXC, and PXD.

This allows a single nozzle N to be associated with a drive waveform signal COM common to the STATES. Thus, all the nozzles N that eject droplets D are more reliably driven according to drive waveform signals COM corresponding to the ranks.

In the above-mentioned embodiment, the control unit 32 develops drawing data Ip into dot pattern data. Without being limited to this, for example, the input/output device 40 may develop drawing data Ip into dot pattern data and input the dot pattern data to the control device 30.

In the above-mentioned embodiment, the actuators are embodied into the piezoelectric elements PZ. Without being limited to this, for example, the actuators may be embodied into resistance heating elements. Any elements that receive predetermined drive waveform signals COM to eject droplets D may be used as the actuators.

In the above-mentioned embodiment, each ejection head 18 includes only one row of 180 nozzles N. Without being limited to this, for example, each ejection head 18 includes two or more rows of 180 nozzles N. Further, the number of nozzles in a row may be larger than 180.

In the above-mentioned embodiment, the electrooptic device is embodied into the liquid crystal display 1 and the color filters CF are manufactured using droplets D. Without being limited to this, for example, the orientation films of the liquid crystal display 1 may be manufactured using droplets D. Alternatively, the electrooptic device may be embodied into an electroluminescence display and droplets D including a light-emitting element forming material may be ejected to manufacture light-emitting elements.

The entire disclosure of Japanese Patent Application No. 2006-325268, filed Dec. 1, 2006 is expressly incorporated by reference herein.

What is claimed is:

1. A droplet ejection device for supplying drive waveforms to multiple actuators provided in a droplet ejection head and ejecting droplets from nozzles corresponding to the actuators, comprising:

an output control signal generator for generating an output control signal in which the multiple nozzles are associated with ejection/non-ejection of a droplet, according to drawing data;

a storage device for storing information in which the multiple nozzles are associated with ranks set according to the weights of droplets;

a drive waveform generator for generating drive waveforms associated with the ranks, the drive waveforms correcting the weights of the droplets to a predetermined weight;

a common select control signal generator for generating a common select control signal in which the multiple nozzles are associated with the drive waveforms corresponding to the ranks, using the information stored in the storage device; and an output device for outputting the drive waveforms corresponding to the ranks to the actuators of the nozzles, according to the common select control signal and the output control signal, wherein the common select control signal generator generates the common select control signal before the output control signal is generated, and the output device outputs the drive waveforms corresponding to the ranks, to the actuators of the nozzles, using the common select control signal generated in advance, each time the output device receives the output control signal.

2. The droplet ejection device according to claim 1, further comprising a droplet weight device for measuring a weight of a droplet.

3. An electrooptic device comprising a film formed by drying a droplet ejected onto a substrate by the droplet ejecting device according to claim 1.

4. A droplet ejection method for supplying drive waveforms to multiple actuators provided in a droplet ejection head and ejecting droplets from nozzles corresponding to the actuators, comprising:

generating an output control signal in which the multiple nozzles are associated with ejection/non-ejection of a droplet, according to drawing data;

storing information in which the multiple nozzles are associated with ranks set according to the weights of droplets;

generating drive waveforms associated with the ranks, the drive waveforms correcting the weights of the droplets to a predetermined weight;

generating a common select control signal in which the multiple nozzles are associated with the drive waveforms corresponding to the ranks, using the information stored in the storage device; and outputting the drive waveforms corresponding to the ranks to the actuators of the nozzles, according to the common select control signal and the output control signal, wherein the common select control signal is generated before the output control signal is generated, and the drive waveforms corresponding to the ranks are output, to the actuators of the nozzles, using the common select control signal generated in advance, each time the output control signal is received.

* * * * *